US008262194B2

(12) United States Patent
Manzone et al.

(10) Patent No.: US 8,262,194 B2
(45) Date of Patent: Sep. 11, 2012

(54) INKJET PRINTER WITH CLEANING DEVICE

(75) Inventors: Mario Manzone, Ivrea (IT); Fabio Dondi, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 1239 days.

(21) Appl. No.: 11/664,267

(22) PCT Filed: Sep. 29, 2005

(86) PCT No.: PCT/EP2005/010513
§ 371 (c)(1),
(2), (4) Date: Mar. 30, 2007

(87) PCT Pub. No.: WO2006/037547
PCT Pub. Date: Apr. 13, 2006

(65) Prior Publication Data

US 2007/0296755 A1 Dec. 27, 2007

(30) Foreign Application Priority Data

Sep. 30, 2004 (IT) ..... TO2004A0653

(51) Int. Cl.
*B41J 2/165* (2006.01)

(52) U.S. Cl. ..... 347/32; 347/23; 347/35; 347/36; 347/29

(58) Field of Classification Search ..... 347/22–23, 347/29–36
See application file for complete search history.

(56) References Cited

U.S. PATENT DOCUMENTS 5,027,134 A 6/1991 Harmon et al.
5,250,962 A 10/1993 Fisher et al.
(Continued)

FOREIGN PATENT DOCUMENTS

EP 0 873 876 B1 10/1998
(Continued)

OTHER PUBLICATIONS

International Search Report from PCT/EP2005/010513, dated Feb. 6, 2006.

*Primary Examiner* — Jason Uhlenhake
(74) *Attorney, Agent, or Firm* — Venable LLP; Robert Kinberg; Steven J. Schwarz

(57) ABSTRACT

An inkjet printer (10) comprising: an inkjet printing head (32); a service station (101) provided for the maintenance of the printing head (32) and having a protective cap (102), in turn adapted to be coupled in contact with a front surface (32*b*, 32*c*) of the printing head (32) to protect it; and a cleaning device (110), associated with the service station, wherein the cleaning device (110) comprises a receptacle (104) adapted to be moved between a first operative position (P5), in which the receptacle (104) is arranged between the protective cap (102) and the front surface of the printing head (32) to receive a determined amount of ink ejected, in the form of drops, by the printing head (32) during programmed cleaning cycles, and a second operative position (P6), in which the receptacle (104) is laterally displaced with respect to the protective cap (102), to allow the contact coupling between the printing head (32) and the protective cap (102). Thanks to this configuration of the cleaning device (110), the inkjet printing head (32) can both couple with the protective cap (102) and carry out the programmed cleaning cycles, while it is arranged in a single determined position (P4) to the side of the relative printing stroke.

27 Claims, 7 Drawing Sheets

U.S. PATENT DOCUMENTS

| | | | | |
|---|---|---|---|---|
| 5,563,637 | A * | 10/1996 | Francis et al. | 347/32 |
| 5,774,139 | A | 6/1998 | Salzer et al. | |
| 6,174,041 | B1 | 1/2001 | Urrutia et al. | |
| 6,766,817 | B2 | 7/2004 | da Silva | |
| 6,846,063 | B2 * | 1/2005 | Spitz et al. | 347/36 |
| 6,874,863 | B2 * | 4/2005 | Usui et al. | 347/40 |
| 6,918,404 | B2 | 7/2005 | Dias da Silva | |
| 7,066,586 | B2 | 6/2006 | da Silva | |
| 2003/0090535 | A1 * | 5/2003 | Park | 347/29 |
| 2005/0045096 | A1 * | 3/2005 | Kojima | 118/323 |
| 2005/0179713 | A1 * | 8/2005 | Waller et al. | 347/9 |

FOREIGN PATENT DOCUMENTS

| | | | |
|---|---|---|---|
| EP | 1 080 909 | A1 | 7/2001 |
| WO | WO-2006/005560 | | 1/2006 |

* cited by examiner

INKJET PRINTER WITH CLEANING DEVICE

FIELD OF THE INVENTION

The present invention relates in general to an inkjet printer, and in greater detail it refers to a printer of the type comprising an inkjet printing head that is associated with a cleaning device for carrying out programmed cleaning cycles of the inkjet printing head itself.

The present invention also concerns a corresponding method for carrying out a cleaning cycle of an inkjet printing head.

TECHNICAL BACKGROUND OF THE INVENTION AND STATE OF THE ART

In the field of printers comprising a print unit provided with an inkjet printing head, numerous solutions and devices aimed at keeping the printing head constantly in an effective state, so that it is ready to print at any time, are known.

In particular, these solutions foresee both the use of devices adapted to protect and cover the area of the printing head nozzles during the relative periods of inactivity, and the execution of programmed cleaning cycles that work together with the protection devices to avoid the ink drying at the nozzles, so as to keep the inkjet printing head effective through time, i.e. always in a condition to print correctly.

In general, these cleaning cycles consist of the emission, against a receptacle, of a certain amount of ink in the form of drops by the inkjet printing head, and are carried out, in a programmed manner, after having parked the inkjet printing head in a certain cleaning position, outside of the printing area and usually provided at the side of the printing path along which the printing head translates back and forth during printing.

A printer of this type is known, for example, from European patent EP 1 080 909 A, and comprises in particular an inkjet printing head, provided with a plurality of nozzles and adapted to move back and forth along a printing area, and also a plurality of stations for the maintenance of the printing head arranged in the area at the side of the relative printing area.

The head is controlled so as to be arranged in a first position, in front of a corresponding hermetic sealing station, to couple with a protective cap, having the function of protecting and hermetically covering a front area of the printing head containing the nozzles, or else in a second position, in front of a corresponding cleaning station, to eject a certain amount of ink towards a vase-shaped receptacle during programmed cleaning cycles.

The Applicant has, however, observed that the solution proposed by this patent requires that the inkjet printing head be arranged in two distinct positions, outside the relative printing area, in order to carry out the necessary maintenance operations to keep it working effectively, i.e. to protect the printing head with the protective cap and to carry out the programmed cleaning cycles.

This solution necessarily involves a significant enlargement of the structure of the printer in the transversal direction, precisely so as to be able to house the inkjet printing head both in the protection position and in the cleaning position, to the side of the printing area.

U.S. Pat. No. 5,027,134 describes a service station for an inkjet printing head, having a cap that encloses and defines a cavity around the printing head when it is not in use, a basin to collect the ink discharged from the printing head and also a vent to prevent changes of pressure within the cavity, wherein within the cap capillary spaces, adapted to convey the liquid collected in the basin so as to move it away from the vent to prevent the vent from clogging, are formed.

When the printer starts up, or at selected times during printing, an algorithm activates the printing head to eject ink through the respective nozzles within the cap and the basin, so as to clean the nozzles and remove any ink clogging.

The Applicant has, nevertheless, observed that these solutions substantially complicate the manufacturing of the service station and of the relative protective cap, and also pose problems of evacuation of the cleaning ink that is ejected by the printing head inside the cavity defined by the protective cap, as well as problems of seal with respect to the outside of the cavity itself adjacent to the area of the nozzles.

SUMMARY OF THE INVENTION

The Applicant has perceived the problem of making a printer, of the type comprising a inkjet printing head and equipped with a service station, being of a size in the transversal direction not conditioned by the requirement to house the inkjet printing head in two distinct and different positions, in an area to the side of the printing area, in order to carry out the maintenance operations on the inkjet printing head and the closing and protection operations of the relative nozzles.

Moreover, the Applicant has perceived the problem of avoiding the ink ejected during the cleaning operations and collected inside the protective cap of the printing head to be evacuated using complex structural solutions, in particular implying additional provisions to ensure the hermetic seal of the space inside the protective cap.

Considering this, the Applicant has found that such problems can be solved by keeping the closing and protection function of the nozzles, carried out by the cap, separate from the collection function of the ink ejected during the cleaning cycles, carried out by the receptacle of the service station, arranging the cap and the service station with the receptacle in contiguous positions, and further moving the cap and the receptacle arranged in a position facing the printing head according to a predetermined sequence.

According to a first aspect, the invention relates to an inkjet printer comprising:

- an inkjet printing head mobile between a printing area and a service position;
- a service station having a protective cap mobile between a position distanced from said printing head and a position in contact with the printing head in the respective service position; and
- a cleaning device associated with the service station and comprising a receptacle for the collection of ink ejected by the printing head, wherein the printer is characterized in that the receptacle is mobile between a first working position, facing the printing head in the service position, with the protective cap in the respective distanced position, and a second rest position displaced with respect to the printing head and such as to allow the coupling in contact between the protective cap and the printing head in the service position.

According to a preferred solution, the receptacle is mobile between the working position and the rest position along a direction substantially parallel to the movement of the printing head in the relative printing area.

Alternatively, the receptacle is provided to move between the respective working and rest positions along a direction substantially perpendicular to the movement of the printing head in the relative printing area.

Preferably, the receptacle is configured like a substantially plain wall arranged parallel to a front surface of the printing head.

More preferably, the receptacle is slidably supported with respect to a fixed structure of the printer along a direction substantially parallel to the printing stroke of the printing head.

In a second aspect, the invention relates to a method for the maintenance and protection of an inkjet printing head, comprising the following steps:

arranging the printing head in a service position;

alternatively arranging a receptacle for collecting ink or a protective cap in a respective operative working position cooperating with said printing head in the service position; and carrying out a predetermined cleaning operation of the printing head, when the ink-collection receptacle is in the respective operative working position.

In a preferred embodiment of the method, the operation of moving the receptacle in the respective operative working position, from a respective operative rest position displaced with respect to the service position of the printing head, takes place along a direction substantially parallel to the printing stroke of the printing head.

Alternatively, the operation of moving the receptacle into the respective operative working position, from a respective operative rest position displaced with respect to the service position of the printing head, takes place along a direction substantially perpendicular to the printing stroke of the printing head.

BRIEF DESCRIPTION OF THE DRAWINGS

These and other characteristics of the invention shall become clearer from the following description of an embodiment, with reference to the figures of the attached drawings, in which.

DETAILED DESCRIPTION OF A PREFERRED EMBODIMENT OF THE INVENTION

Figure 1:
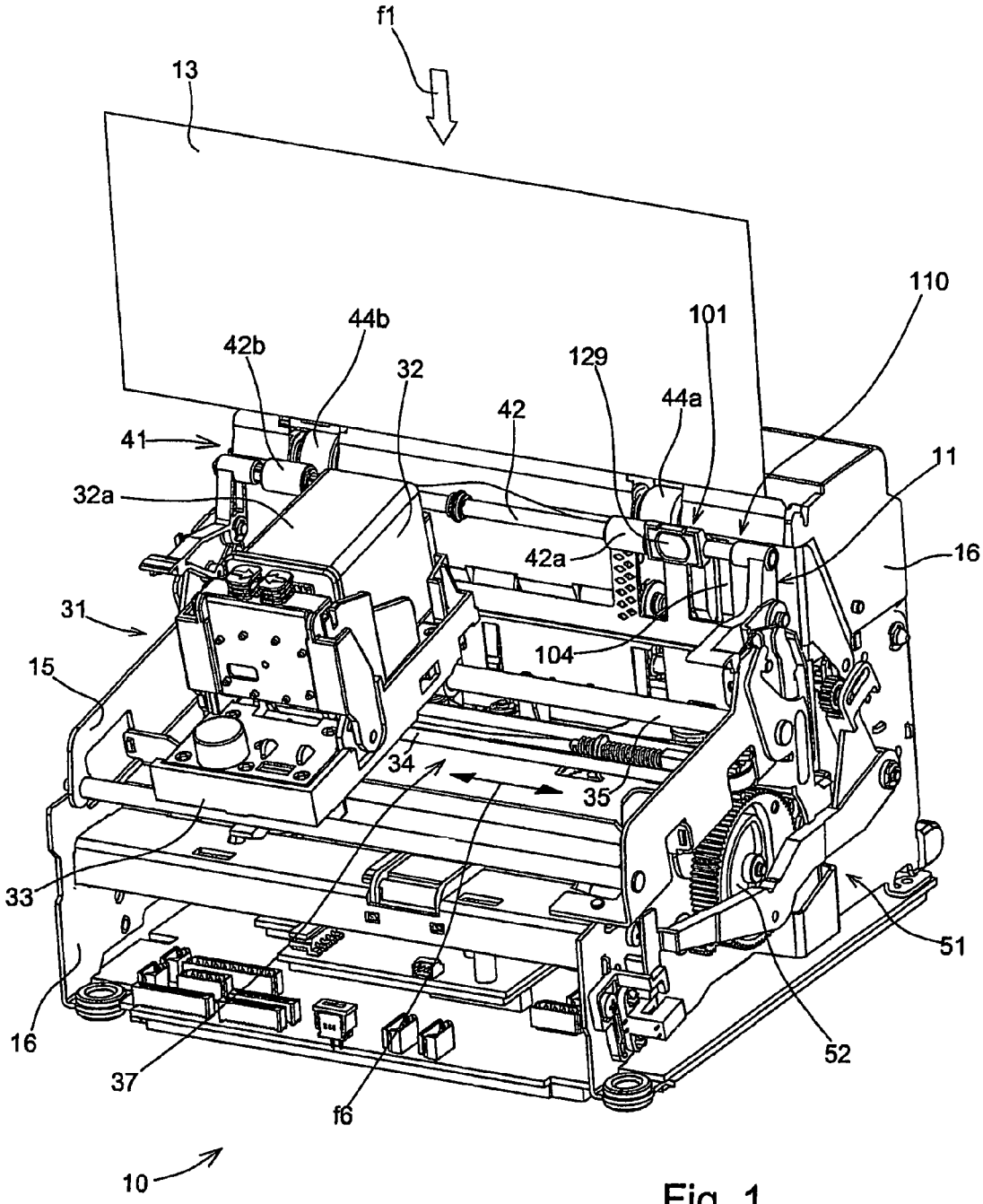
FIG. 1 is a partial perspective view of an inkjet printer, without the outer body, made in accordance with the present invention.

With reference to FIG. 1 an inkjet printer, made in accordance with the present invention, is wholly indicated with 10.

For the sake of being concise, the following description shall be essentially limited to those parts and devices of the printer 10 that are of particular relevance for the present invention and are useful for its complete understanding.

For further details and characteristics of the printer 10, not closely involved in the invention, as well as other information on the structure and general operation of an inkjet printer, reference is made to what is already known in the prior art, for example as described in Italian patent application no. T02004A000484 and in European patent EP 0 873 876 B1, both owned by the Applicant.

In particular, the inkjet printer 10 comprises a printing device 31, which is arranged inside the printer 10 and is provided with a printing head 32 adapted to operate based upon the so-called inkjet technology to print a plurality of sheets 13, one at a time, fed from outside of the printer 10.

The sheets 13 can be introduced from the outside and be fed in whatever way to the printer 10 to be printed by the printing device 31.

As an example, in the illustrated embodiment of the printer 10, the sheets 13 are introduced into the printer along a vertical guide 11, provided on top of the printer 10, as indicated by an arrow f1, in said vertical guide 11 the sheets 13 to be printed being able to be simply left to fall by gravity by a user.

Other ways of introducing the sheets 13 into the printer 10 to be printed by the printing device 31 are possible, for example through picking up sheets from a ream of paper and feeding them through supply rollers.

The printer 10 also comprises a structure indicated with 15 or 16 (FIG. 2) to support the various parts, both fixed and mobile, of the printer 10 itself; a feeding device, wholly indicated with 41 and associated with the vertical guide 11, which is adapted to receive a generic sheet 13 introduced into the vertical guide 11, and to subsequently feed it, in order to be printed, towards the area of the printing device 31; and finally an electronic control unit, not represented in the drawings, adapted to control the general operation of the printer 10.

The feeding device 41 in particular carries out the function of taking the sheet 13 and holding it safely, once it has been manually introduced into the guide 11, guiding it and feeding it towards the area of the printing device 31, and finally of correctly positioning the sheet 13 in front of the printing head 32 in order to be printed thereby.

In particular, this feeding device 41 comprises a plurality of rollers 42*a*, 42*b*, 44*a* and 44*b* that close in contact with the sheet 13, once introduced in the vertical guide 11, and which are commanded into rotation, through a kinematic chain comprising a plurality of gears, by a feeding motor 45 (FIG. 2), in order to translate the sheet 13 from the area of the vertical guide 11 to the area of the printing device 31.

Figure 7A:
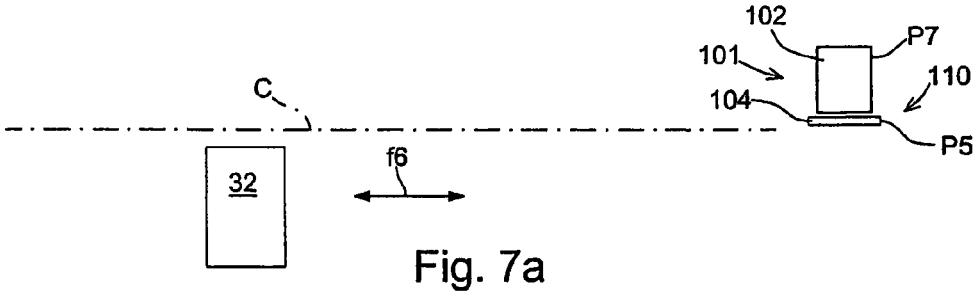
FIGS. 7*a*-7*e* schematically illustrate the printer of FIG. 1 with the relative service group and cleaning group arranged in different operative positions.

The inkjet printing head 32 of the printing device 31 is arranged in a printing area, inside the printer 10, and for example is of the serial type, i.e. it is suitable for travelling a given printing stroke C in both ways with respect to the sheet 13, as indicated by a double arrow f6 (FIGS. 1 and 2) and schematised with a dotted and dashed line in FIG. 7*a*, to print one or more printing lines in succession on the same sheet 13.

For this purpose, the head 32 is removably mounted on a mobile carriage 33 that is in turn associated with a transportation device 37 adapted to translate the carriage 33 back and forth in front of the sheet 13, along guides 35, and thus allow the printing head to print a printing line on the sheet 13.

For example, this transportation device 37 comprises a transportation motor, not represented in the drawings, and a belt 34 for transmitting the motion from the transportation motor to the carriage 33.

The printing head 32 is of the known type, operating based upon inkjet technology, and therefore we shall only provide a few summary details thereof, ignoring most of the other ones since they are widely known and do not closely relates to the present invention.

Purely for indicating purposes, the printing head 32 has an anterior or front surface 32*b* (FIG. 2), adapted to translate in front of the sheet 13 to be printed, which is configured with a plurality of nozzles 32*c* arranged along two parallel side-by-side rows orientated perpendicularly to the translation motion of the head 32, corresponding to the double arrow f6, so as to be able to cover a printing band or line.

The printing head 32 is also associated with an inner reservoir 32*a*, integral with the head 32 itself, the volume of which is occupied by a spongy element impregnated with the ink necessary to print with the head 32.

Suitable passages are provided to place the inner reservoir 32*a* in communication with the external air pressure.

The printing head 32 can be of the reloadable type, once the ink in the relative reservoir 32*a* has run out, for example by placing it in a suitable reloading container, where new ink is transferred to the reservoir 32*a* of the printing head 32 through a hole 32*d*.

Alternatively, the printing head can be of the single-use type, provided to be entirely replaced once the load of ink has run out.

The printing head 32 is also associated with a service group, better described later on, having the function of keeping the area of the nozzles of the printing head always in order and clean, during service.

Service Station for the Inkjet Printing Device

Figure 2:
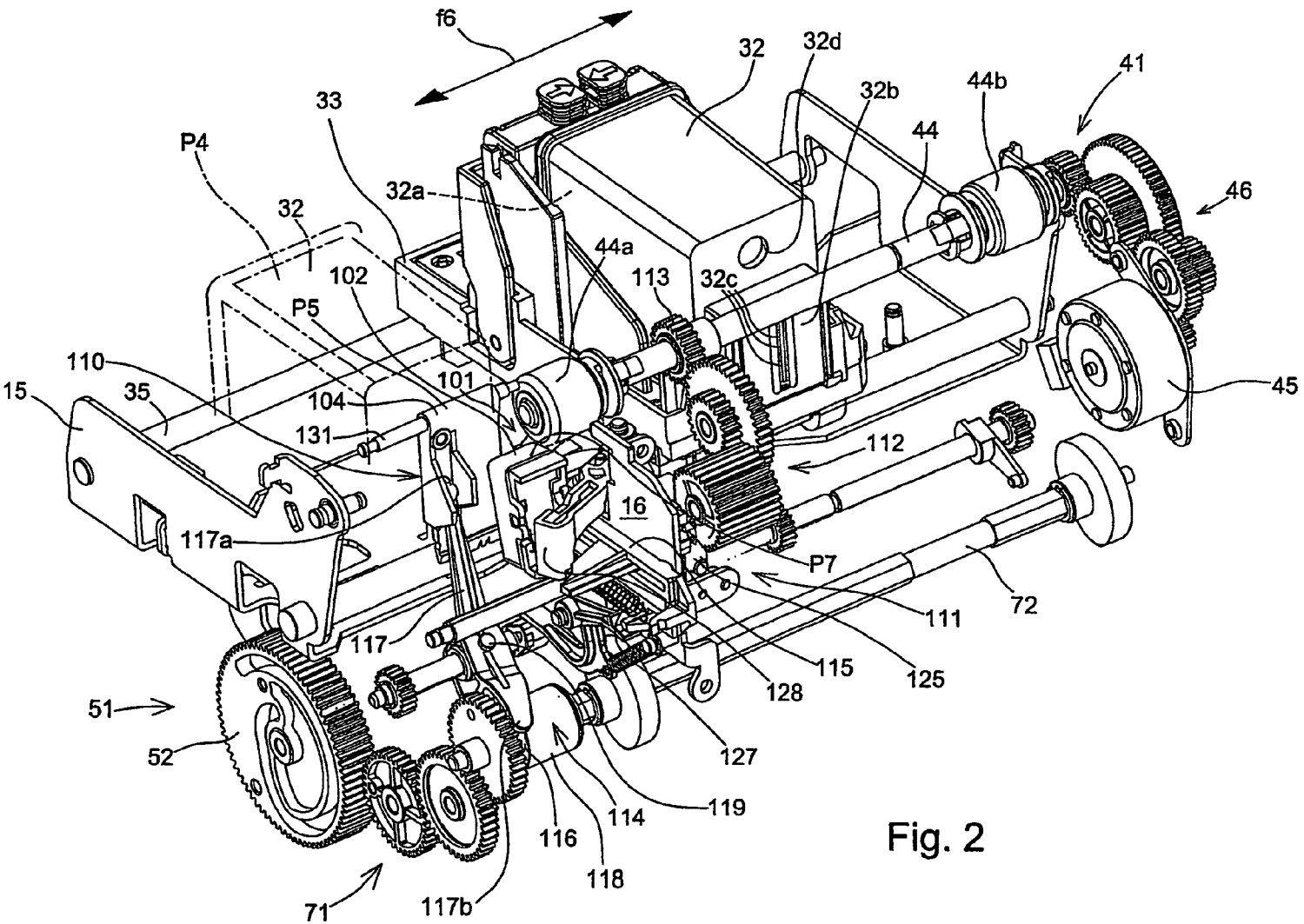
FIG. 2 is a first partial perspective view of a service group and of a cleaning device for an inkjet printing head of the printer of FIG. 1, represented in a first operative configuration.
Figure 3:
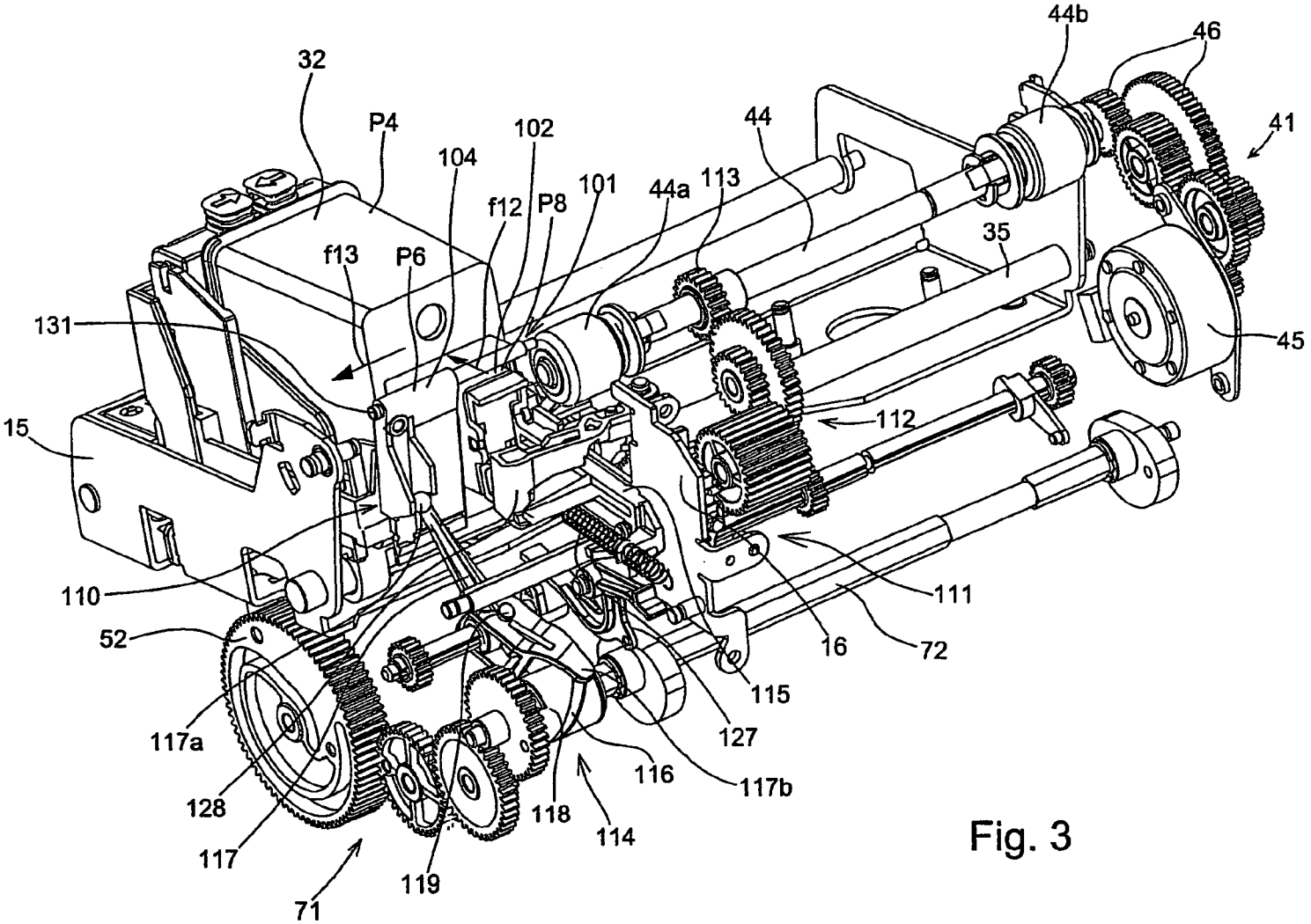
FIG. 3 is a second partial perspective view of a service group and of the cleaning device of FIG. 2, represented in a second operative configuration.
Figure 4:
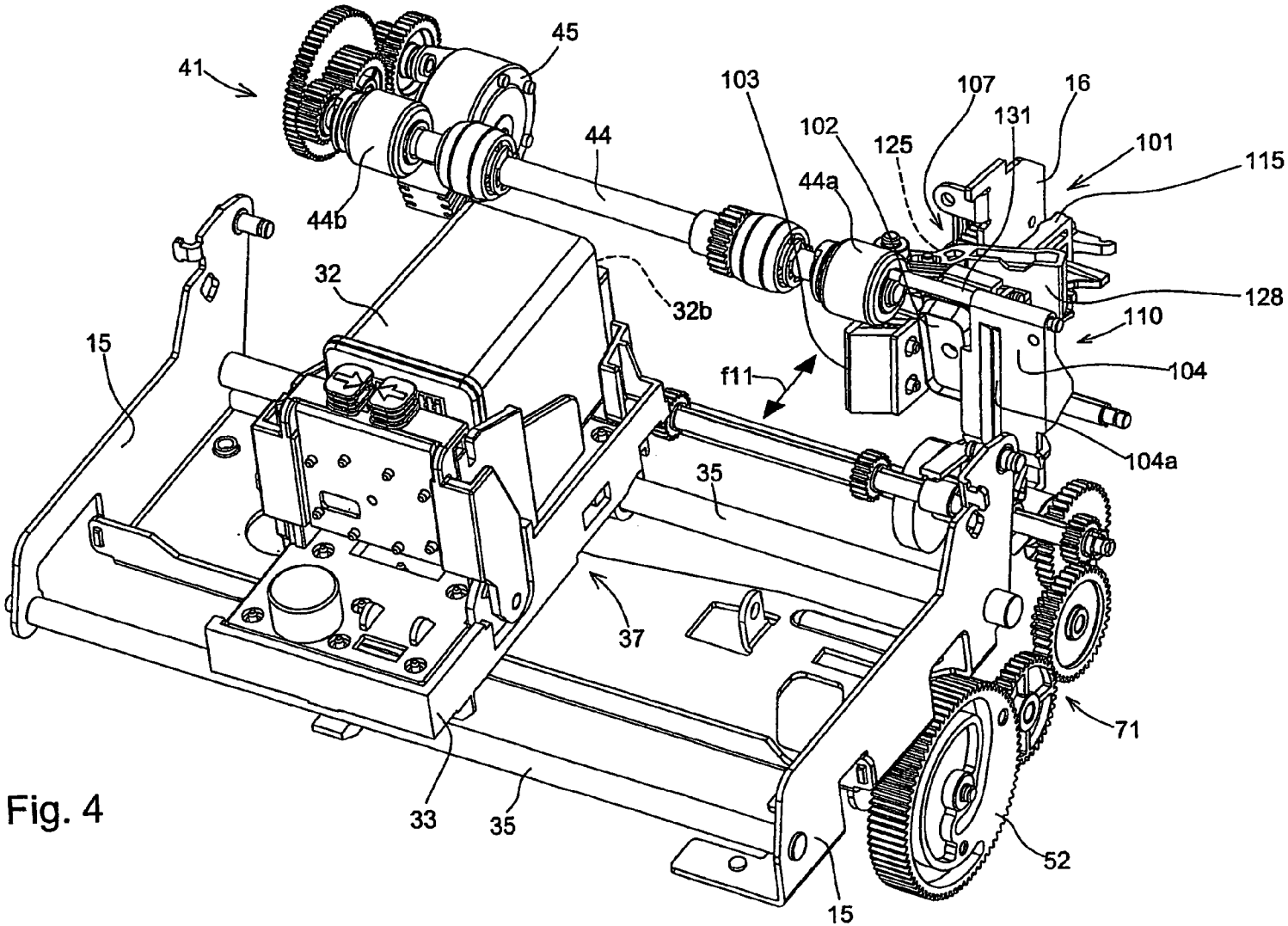
FIG. 4 is a further partial perspective view, from a different point of view, of the service group and of the cleaning device of FIGS. 2 and 3.

As stated above and with reference to FIGS. 2-4, the printer 10 also comprises a service group or station, generally indicated with 101, at which the printing head 32 is parked in periods of inactivity, in a respective service position P4, and which is preferably arranged along a side of the printer 10, outside of the area of the horizontal stroke that the printing head 32 travels back and forth to print the sheet 13.

This service group 101 has the purpose of keeping the inkjet printing head 32 constantly clean and in good efficiency order during the use of the printer 10.

To this end, the service group 101 comprises a protective cap 102 and a cleaning blade 103, wherein each of these parts is provided to carry out a determined maintenance and cleaning function of the printing head 32.

In particular, the protective cap 102 is provided to be selectively brought into contact with the front surface 32*b* of the printing head 32, carrying the nozzles 32*c* for the ejection of the drops of ink, in order to protect and cover such nozzles, and thus prevent them from drying out during periods of inactivity of the printing head 32.

In turn, the cleaning blade 103 has the specific function of sliding in contact with the front surface 32*b* of the printing head 32, whereas the latter is activated so as to move horizontally back and forth for a certain length, in order to remove possible ink residue and dirt accumulated during the use of the printing head 32 from such a front surface, and in particular from the area of the nozzles 32*c*.

The protective cap 102 and the cleaning blade 103, in order to carry out the respective service functions described above, are provided to be controlled by appropriate mechanisms, which are associated with the service group 101.

Figure 5:
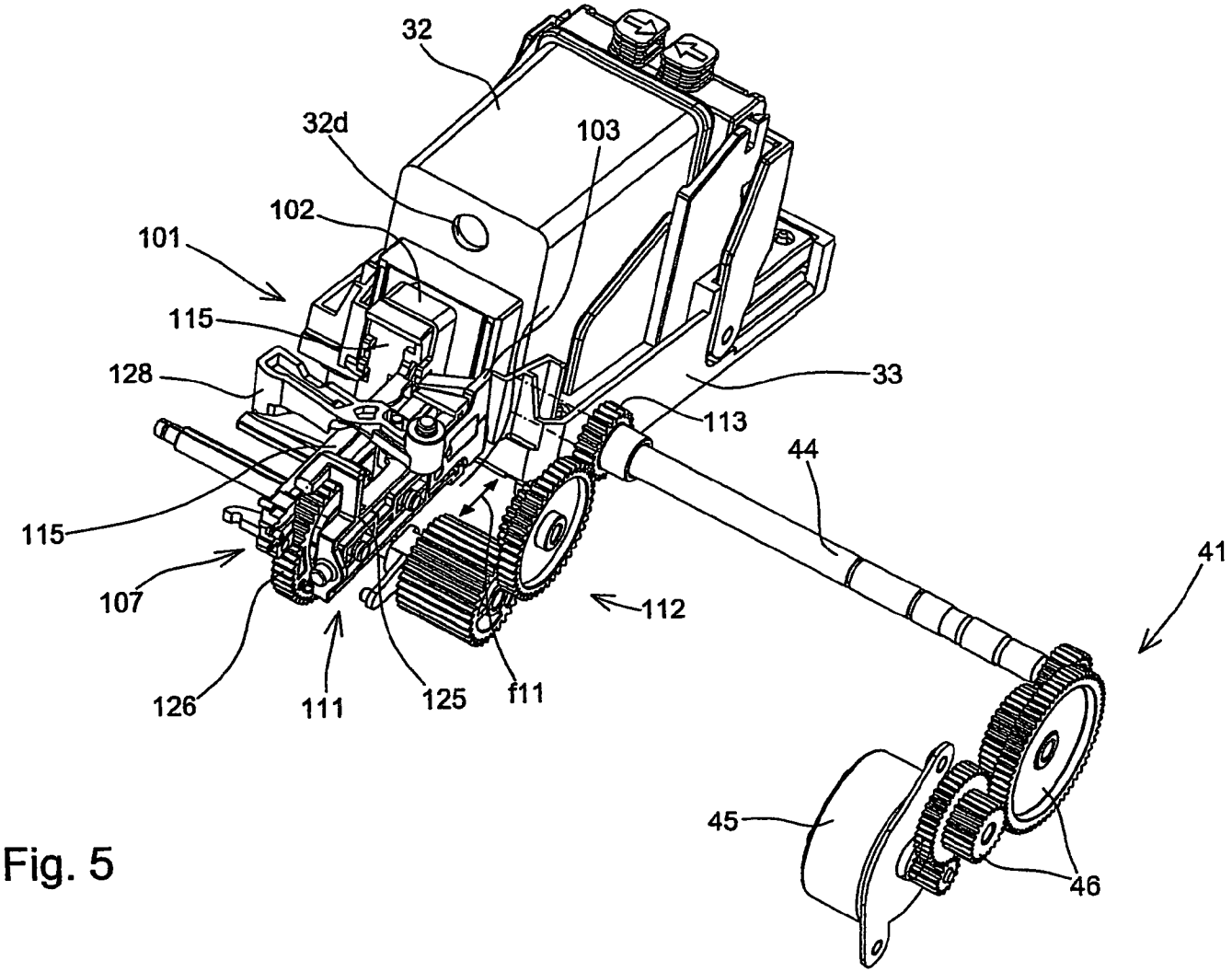
FIGS. 5 and 6*a*-6*b* are perspective views of further details and mechanisms associated with the service group and the cleaning device of FIGS. 2 and 3.

In particular, a first moving mechanism, generally indicated with 111, is associated with a support 125, in turn carrying the cleaning blade 103 and slidably mounted on the fixed structure 16, and has the function of moving the support 125 back and forth in the transversal direction with respect to the translation path of the printing head 32, as indicated by a double arrow f11 (FIG. 5), between a first non-operative position, in which the cleaning blade 103 is spaced from the translation path of the printing head 32, and a second operative position, in which the cleaning blade 103 interferes with such a translation path.

The moving mechanism 111 is controlled directly by the same feeding motor 45 of the vertical feeding mechanism 41, through a kinematic chain that transmits the motion of the feeding motor 45 to a gear 126, belonging to the mechanism 111, which incorporates a cam adapted to control the back and forth motion, indicated by the double arrow f11, of the support 125, carrying the cleaning blade 103, in response to a rotation of the gear 126.

In particular, this kinematic chain comprises a series of gears 46 (FIGS. 3 and 5) arranged downstream of the motor 45 and in common with the vertical feeding mechanism 41, the shaft 44 carrying the motor rollers 44*a* and 44*b*, and a series of gears 112 provided to transmit the motion from a toothed crown 113, integral with the shaft 44, to the gear 126 that controls the support 125.

The protective cap 102 is in turn mounted on a respective support 115, adapted to slide on the fixed structure 16 and distinct from the support 125 that carries the cleaning blade 103.

The support 115, carrying the protective cap 102, is also subjected to the action of a spring 127 that tends constantly to push the support 115 and thus the protective cap 102 towards the translation path of the printing head 32, i.e. towards the printing head 32 parked in the relative service position P4.

A second holding mechanism 107 (FIG. 4), associated with the first moving mechanism 111, has the function of selectively cooperating with the support 115, carrying the protective cap 102, to allow or not allow the protective cap 102 to engage with the printing head 32, respectively when a protection cycle of the printing head 32 or else a cleaning cycle of the surface 32*a* of the printing head 32 is programmed.

In particular, in the case in which a cleaning cycle is foreseen, the support 125 is controlled by the moving mechanism 111, in response to a rotation of the feeding motor 45, to bring the cleaning blade 103 into interference with the translation path of the printing head 32, whilst the holding mechanism 107 in turn intervenes to hold the support 115, in contrast to the action of the spring 127, in a position corresponding to a withdrawn position P7 (FIG. 2) of the protective cap 102, in which the latter is spaced from the printing head 32 and from the relative translation path, so as not to disturb and hinder the cleaning operation of the printing head 32 by the cleaning blade 103.

On the contrary, in the case in which a protection cycle of the printing head 32 is foreseen, after having parked the printing head 32 itself in the service position P4, the holding mechanism 107 intervenes to free the support 115 in the position, corresponding to the withdrawn position P7 of the protective cap 102, in which the support 115 was held by the holding mechanism 107 itself, so as to allow the support 115, under the action of the spring 127, to move towards the printing head 32, and thus bring the protective cap 102 into a contact position P8 (FIG. 3), in contact with the front surface 32*b* thereof to protect it.

A lever 128, pivoted on the fixed structure 16, is further provided to be controlled by the translation motion of the support 125, carrying the cleaning blade 103, and thus to cooperate with the support 115, carrying the protective cap 102, so as to bring the support 115 back, in contrast to the action of the spring 127, from the advanced position corresponding to the contact position P8 of the protective cap 102, once again in the withdrawn position, corresponding to the spaced position P7 thereof with respect to the printing head 32, in which the support 115 is held by the holding mechanism 107.

In this way, the service group 101 is able to carry out the maintenance of the printing head 32, in a selective manner and during distinct time periods, or by means of the cleaning blade 103, in order to remove ink residue from the area of the nozzles 32*c* of the printing head 32, or by means of the protective cap 102, in order to cover and protect the nozzles 32*c*.

A further retainer mechanism, associated with the first moving mechanism 111 and with the holding mechanism 107, is provided to selectively carry out a retaining and control function on the support 125 and on the support 115 respectively carrying the cleaning blade 103 and the protective cap 102 so that, when the vertical feeding device 41 is activated to move the sheet 13 vertically, for example to feed it downwards after its introduction into the guide 11, or to eject it upwards after printing, the protective cap 102 and the cleaning blade 103 are each held in a respective position such as not to interfere with the vertical moving path of the sheet 13.

In the case in which the head is of the reloadable type, the printer 10 advantageously also comprises a sealing element 129 to close and seal the hole 32*d* formed on the printing head 32 and adapted to allow it to be reloaded with ink, wherein this sealing element 129 has the shape of a lid mounted on a shaft 42 carrying the rollers 42*a* and 42*b* of the feeding mechanism 41.

When the printing head 32, in periods of inactivity, is parked in the service station area 101, the shaft 42 is moved by mechanisms of the printer 10 so as to bring the sealing element 129 into contact with the printing head 32 to close the hole 32*d*.

By doing so, the ink is prevented from drying up in the area of the hole 32*d*, blocking it, and it is therefore ensured that the printing head 32 is constantly in conditions to be reloaded with ink through the hole 32*d*.

Cleaning Device

The inkjet printer 10 comprises a cleaning device, generally indicated with 110 and functionally associated with the service station 101, which works with the latter to keep the inkjet printing head 32 continually in good efficiency, during use, and wherein this cleaning device 110 specifically has the function of receiving and conveying a certain amount of ink ejected by the printing head 32, in the form of drops, during programmed cleaning cycles.

Each of these cleaning cycles is carried out by activating the inkjet printing head for a certain period of time, according to programmed ways, after having parked the printing head 32 in a corresponding cleaning position, usually in an area situated to the side of the relative horizontal printing translation path.

In general, these cleaning cycles are programmed at the moment when the printer is switched on, i.e. before normal use of the printing head, so as to ensure that it works correctly right from the outset, or else after a prolonged period of inactivity of the printing head.

As shall be understood better hereafter, this cleaning device 110 ensures that the printer 10 can be manufactured, having the same stroke of the printing head, with a particularly reduced transversal bulk.

Indeed, thanks to the special configuration of the cleaning devices 110, the structure of the printer 10 can be sized so as to house the printing head 32, to the side of the relative printing stroke C, only in a single position, to cooperate either with the protective cap or with the cleaning device and thus to carry out the foreseen maintenance operations.

The cleaning device 110 incorporated in the printer 10 and its relative operation shall be now described in detail, also with reference to the schemes of FIGS. 7*a*-7*d*, for the sake of clarity.

In particular, the cleaning device 110 comprises a cleaning wall or receptacle 104, and a control mechanism 114 connected with the cleaning wall 104 to move it selectively with respect to the protective cap 102, along a direction substantially parallel to the horizontal translation direction of the printing head 32.

The receptacle or cleaning wall 104 consists of a roughly rectangular plain wall, arranged in a plane substantially parallel to that of the front surface 32*b* of the printing head 32 and slidably mounted on a small shaft 131, in turn integral with the fixed structure 16 and orientated parallel to the printing stroke of the printing head 32.

Figure 6A:
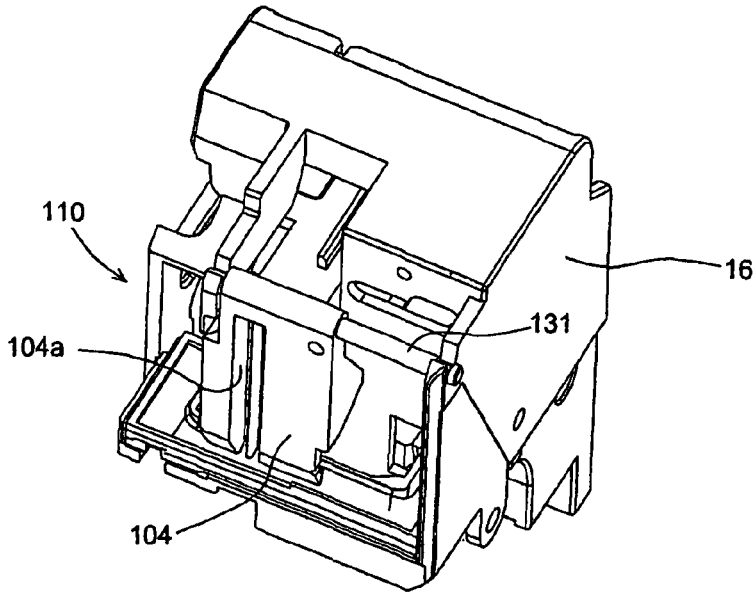
Figure 6B:
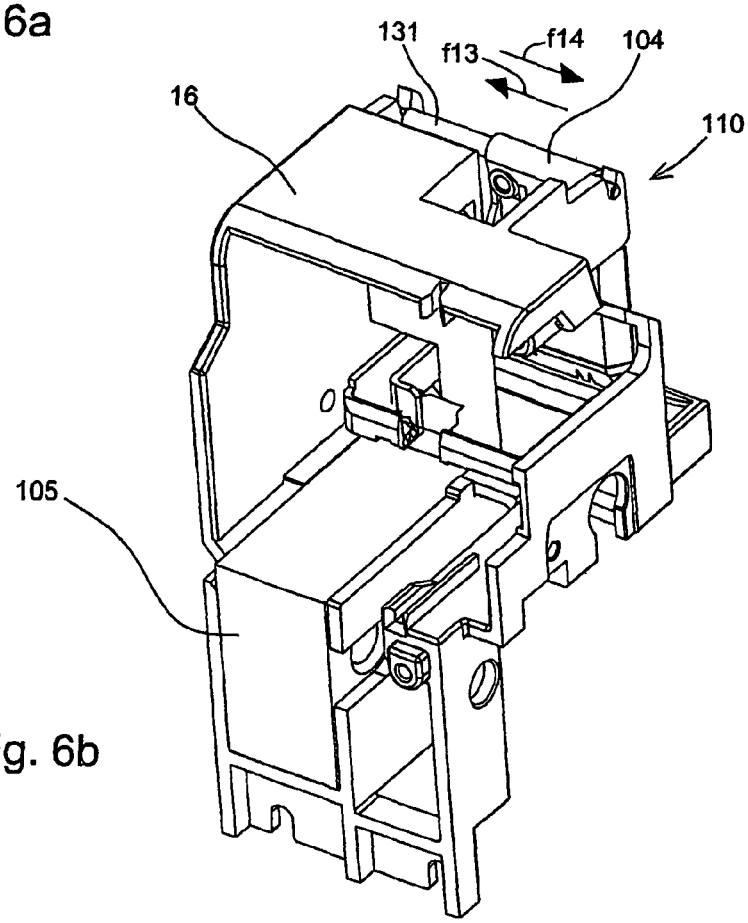

In use, as better described later on, this receptacle 104 has the function of receiving, during determined programmed cleaning cycles of the printing head 32, a certain amount of ink ejected from the printing head 32 itself, to convey it suitably towards a collection means, such as a porous element 105, visible in FIG. 6*b*, consisting of one or more layers or panels of absorbent material known by the name Porex.

For this purpose, the cleaning wall 104 carries a vertical channel 104*a* (FIG. 4), etched along the plain front surface of the cleaning wall 104, to collect the liquid ejected by the printing head 32 and convey it downwards and thus towards the porous element 105.

As can be seen in FIGS. 2 and 3, which show the service group 101 and the cleaning device 110 together with other details of the printer 10, the control mechanism 114 comprises: a closed helical groove 116, which is formed on the outer surface of a cylindrical body 118, integral and coaxial with a shaft 72; and also a lever 117, rotatable about a pivot 119, which is directly connected at one end 117*a* with a face of the cleaning wall 104, opposite the one that receives the ink, and is adapted to cooperate at the other end 117*b* with the groove 116.

The coupling between the end 117*a* of the lever 117 and the cleaning wall 104 is not rigid but forms an articulated joint, as can be seen in FIG. 3, to allow the cleaning wall 104 to translate and move freely back and forth along the small shaft 131 in response to the rotation of the lever 117 about the pivot 119.

In this way, the control mechanism 114 is configured to be activated by a rotation of the shaft 72, which is in turn adapted to be rotated by a control device 51 of the printer 10.

In particular, the control device 51 is provided to carry out a plurality of functions in the operation of the printer 10, in addition to that of controlling the control mechanism 114, and comprises in particular a driving motor, not represented in the drawings, which is provided to drive the shaft 72 into rotation, through a kinematic chain including a cam driving member 52 of the control device 51 and a series of gears 71 arranged downstream of the driving member 52.

Operation of the Service Station and of the Cleaning Device

In normal conditions, for example while the printing head 32 translates back and forth along its printing stroke C, as indicated by the double arrow f6 and represented in FIGS. 2 and 7*a*, to print a text onto the sheet 13, the cleaning wall 104 is held by the relative control mechanism 114 in a first operative or working position, indicated with P5, in front of the protective cap 102, whereas the latter is in turn held, by the mechanisms provided to control the support 115 on which the protective cap 102 is fixed, in a withdrawn or distanced position P7 with respect to the printing head 32, i.e. such as not to intercept its translation path.

In this position P5, in particular represented in FIG. 2, the cleaning wall 104 is already set up to receive the ink that shall be ejected by the printing head 32 during the relative cleaning cycles.

Figure 7B:
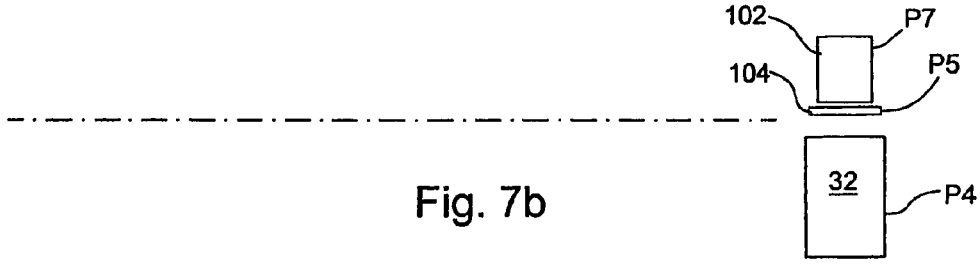

Therefore, when, in a subsequent step, the program residing in the control unit of the printer 10 and provided to manage the operation of the latter foresees that the printing head 32 must carry out a cleaning cycle, then the control unit makes the printing head 32 move along the respective translation path, through the transportation device 37, so as to take it and park it, if it has not already done so, in the area of the service station 101, in a service position P4 indicated with a dotted and dashed line in FIG. 2 and schematised in FIG. 7*b*, exactly in front of the cleaning wall 104, in turn arranged in front of the protective cap 102.

In this step the cleaning wall 104 and the protective cap 102 are not moved by the respective moving mechanisms, but continue to remain still in the configuration described above, thus with the cleaning wall 104 arranged in the operative position P5 in front of the protective cap 102 and the latter arranged in the withdrawn or distanced position P7 with respect to the translation path of the printing head 32.

Then, once parked, the printing head 32 is activated by the control unit so as to eject a given amount of ink, in the form of drops, onto the cleaning wall 104, according to a programmed cycle.

In turn, the ink ejected onto the cleaning wall 104 is conveyed along the channel 104*a* towards the porous element 105, where the ink is held.

Figure 7C:
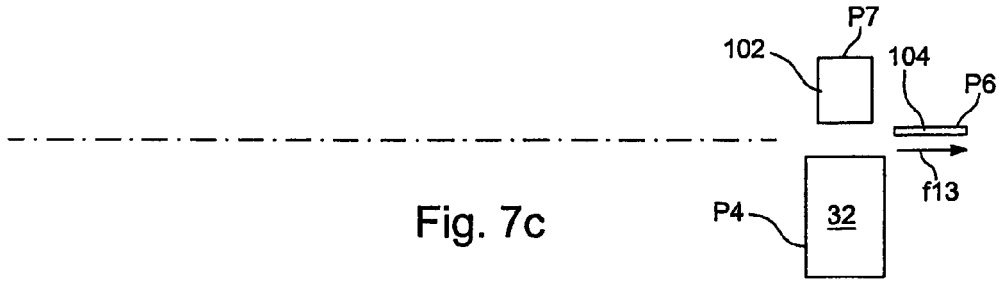

If, on the other hand, with reference to FIGS. 3 and 7*c*, the program that manages the operation of the printer 10 foresees that the printing head 32 must be protected with the protective cap 102, the control unit activates the control mechanism 114 of the cleaning device 110, activating a determined rotation of the shaft 72 through the driving motor 45, so as to laterally move the cleaning wall, in the way indicated by an arrow f13, from the first operative or working position P5 to a second operative or rest position P6, in which the cleaning wall 104 is moved laterally with respect to the protective cap 102, so as not to clog up the area in front of it.

At the same time, the control unit, through the transportation device 37, commands a horizontal translation of the printing head 32, so that it stops, if it has not done so yet, in the area of the service station 101 and more specifically in the aforementioned position P4, as schematised in FIG. 7*c*, i.e. exactly in front of the protective cap 102 but without the interposition of the cleaning wall 104, so as to be able to couple in contact with it.

Figure 7D:
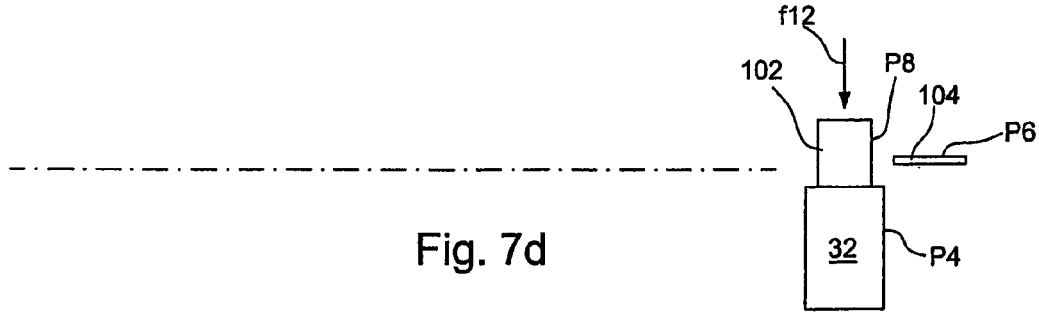

Then, finally, the control unit of the printer 10 controls the mechanisms described above, associated with the service station 101, to bring the protective cap 102 from the withdrawn position P7 to a position P8 in contact with the printing head 32, so as to protect the relative area of the nozzles 32*c*, as indicated by an arrow f12 in FIG. 3 and schematised in FIG. 7*d*.

Figure 7E:
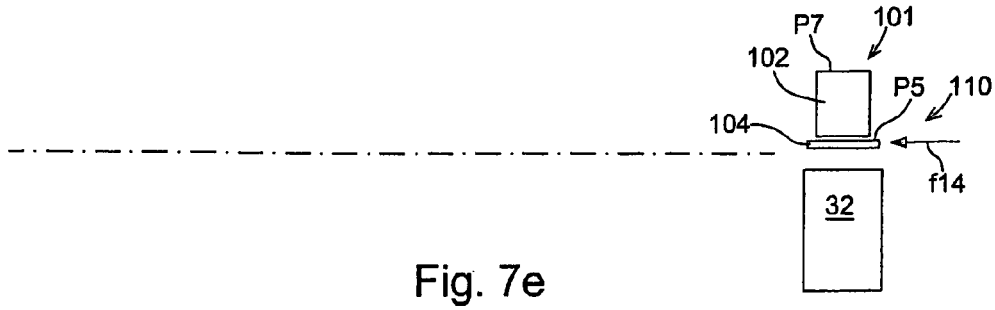

When, thereafter, with reference to FIG. 7*e*, the management program of the printer 10 requires that the printing head must once again be used to print, or else to carry out a cleaning cycle, the control unit commands first of all the detachment of the protective cap 102 from the printing head 32, and then, in the first case, the displacement of the printing head 32 from the area in front of the protective cap 102 towards a printing area, or else, in the second case, whereas the printing head 32 continues to remain still in the service position P4, the displacement, through the control mechanism 114, of the cleaning wall 104 from the rest position P6 to the working position P5, in the opposite way to that of the arrow f13 and as indicated by an arrow f14.

Therefore, in both cases the cleaning wall 104 is once again arranged in the working position P5 in front of the protective cap 10, in turn arranged in the position P7, so as to reset the configuration represented in FIG. 2 and schematised in FIG. 7*a*.

The operations and movements described above are then repeated, in a substantially unchanged form, for the printing head 32, the protective cap 102 and the cleaning wall 104, according to the maintenance steps foreseen by the program that lies in the control unit and manages the operation of the printer 10.

Therefore, the cleaning device 110 described above is such as to allow both the printing head 32 to be protected with the protective cap 102, and the cleaning cycles, which are periodically programmed for the same printing head 32, to be carried out, whilst the printing head is arranged and parked in a single and determined position, in an area to the side of the relative printing stroke, i.e. the position P4 that is indicated in FIGS. 2 and 7*a*.

This characteristic, as already explained earlier, is associated with particularly advantageous effects, such as the possibility of substantially limiting the size in the transversal direction of the printer 10.

Previously, the movement that is carried out by the receptacle provided to receive the drops of ink ejected by the printing head during the cleaning cycles and that has the purpose of freeing the area in front of the protective cap, so as to allow the coupling between the latter and the inkjet printing head, was described to occur in a direction parallel to the printing stroke of the printing head; alternatively, the receptacle can be associated with corresponding moving means adapted to move the receptacle itself, instead of parallel to the printing stroke, in other directions, for example in the transversal direction, based upon bulk requirements of the specific architecture of the printer.

The invention claimed is:

1. Inkjet printer comprising:

an inkjet printing head;

a protective cap mobile between a position distanced from said printing head and a position in contact with said printing head in a service position; and a receptacle for the collection of ink ejected by said printing head, wherein said receptacle is mobile along a horizontal direction substantially parallel to the movement of said printing head in the relative printing area between a working position, facing said printing head in said service position, with said protective cap in said distanced position, and a rest position displaced with respect to said printing head and such as to allow the coupling in contact between said protective cap and said printing head in said service position;

wherein said protective cap is operatively associated with a cleaning blade and selective moving mechanisms of said protective cap and of said cleaning blade with respect to said printing head are also provided, to move said protective cap between said distanced position and said position in contact with said printing head and to move said cleaning blade between a non-operative position and a cleaning position, wherein, in said cleaning position, said cleaning blade interferes with said printing head and said protective cap is in said distanced position from said printing head, and wherein said protective cap is in said position in contact with said printing head, whereas said receptacle is in said rest position.

2. Printer according to claim 1, wherein said inkjet printing head is mobile between a printing area and said service position.

3. Inkjet printer according to claim 1, wherein said receptacle is in the form of a substantially level wall parallel to a front surface of said printing head.

4. Inkjet printer according to claim 3, wherein said receptacle is slidably supported with respect to a fixed structure of the printer along a direction substantially parallel to the printing stroke of said printing head.

5. Inkjet printer according to claim 1, wherein said receptacle is part of a cleaning device that in turn comprises a control mechanism adapted to control said receptacle to move it between said working position and said rest position, said control mechanism being of the type including a helical groove and an intermediate member adapted to be controlled by said helical groove to move said receptacle.

6. Inkjet printer according to claim 5, wherein said intermediate member is rotatable about a pivot and is connected with said receptacle with an articulated joint.

7. Inkjet printer according to claim 1, wherein said selective moving mechanisms include a moving mechanism to move said cleaning blade and bring it into interference with the path of said printing head, and a holding mechanism to hold said protective cap in said distanced position from said printing head, in contrast to the thrust of elastic elements acting on said protective cap, and to release said protective cap, so as to allow it to move from said distanced position to said position in contact with said printing head, under the thrust of said elastic elements.

8. Method for the maintenance and protection of an inkjet printing head, comprising:

arranging the printing head in a service position;

alternatively arranging a receptacle for collecting ink so as to face the head and a protective cap so as to be in contact with said head, by moving said receptacle with respect to the protective cap along a direction substantially parallel to the printing stroke of said printing head between a working position, facing said printing head in said service position, with said protective cap in a distanced position, and a rest position displaced with respect to said printing head and such as to allow the coupling in contact between said protective cap and said printing head in said service position; and carrying out a predetermined cleaning operation of said printing head, when the ink-collection receptacle is in the respective operative working position.

9. Method according to claim 8, wherein said printing head is arranged in said service position by transferring it from a printing area.

10. Inkjet printer comprising:

an inkjet printing head;

a protective cap mobile between a position distanced from said printing head and a position in contact with said printing head in a service position; and a receptacle for the collection of ink ejected by said printing head, wherein said receptacle is selectively and independently mobile with respect to the protective cap between a working position, facing said printing head in said service position, with said protective cap in said distanced position, and a rest position displaced with respect to said printing head and such as to allow the coupling in contact between said protective cap and said printing head in said service position, and wherein the receptacle in said working position is interposed between the printing head and the protective cap.

11. Printer according to claim 10, wherein said inkjet printing head is mobile between a printing area and said service position.

12. Printer according to claim 10, wherein said receptacle is mobile between said working position and said rest position along a horizontal direction substantially parallel to the movement of said printing head in the relative printing area.

13. Inkjet printer according to claim 10, wherein said receptacle is in the form of a substantially level wall parallel to a front surface of said printing head.

14. Inkjet printer according to claim 10, wherein said receptacle is part of a cleaning device that in turn comprises a control mechanism adapted to control said receptacle to move it between said working position and said rest position, said control mechanism being of the type including a helical groove and an intermediate member adapted to be controlled by said helical groove to move said receptacle.

15. Inkjet printer according to claim 10, wherein said protective cap is operatively associated with a cleaning blade and selective moving mechanisms of said protective cap and of said cleaning blade with respect to said printing head are also provided, to move said protective cap between said distanced position and said position in contact with said printing head and to move said cleaning blade between a non-operative position and a cleaning position, wherein, in said cleaning position, said cleaning blade interferes with said printing head and said protective cap is in said distanced position from said printing head, and wherein said protective cap is in said position in contact with said printing head, whereas said receptacle is in said rest position.

16. Method for the maintenance and protection of an inkjet printing head, comprising:

arranging the printing head in a service position;

selectively and independently arranging a receptacle for collecting ink or a protective cap in a respective operative working position cooperating with said printing head arranged in the relative service position; and carrying out a predetermined cleaning operation of said printing head, when the ink-collection receptacle is in the respective operative working position;

moving said receptacle so as to arrange said receptacle between the printing head and the protective cap in the respective operative working position, by moving the receptacle from a respective operative rest position displaced with respect to the service position of said printing head.

17. Method according to claim 16, wherein said printing head is arranged in said service position by transferring it from a printing area.

18. Method according to claim 16, comprising the operation of moving said receptacle along a direction substantially parallel to the printing stroke of said printing head, to arrange said receptacle in the respective operative working position from a respective operative rest position displaced with respect to the service position of said printing head.

19. Inkjet printer comprising:

an inkjet printing head;

a protective cap mobile between a position distanced from said printing head and a position in contact with said printing head in a service position; and a receptacle for the collection of ink ejected by said printing head, wherein said receptacle is mobile along a horizontal direction substantially parallel to the movement of said printing head in the relative printing area between a working position, facing said printing head in said service position, with said protective cap in said distanced position, and a rest position displaced with respect to said printing head and such as to allow the coupling in contact between said protective cap and said printing head in said service position, and wherein said receptacle is part of a cleaning device that in turn comprises a control mechanism adapted to control said receptacle to move it between said working position and said rest position, said control mechanism being of the type including a helical groove and an intermediate member adapted to be controlled by said helical groove to move said receptacle.

20. Printer according to claim 19, wherein said inkjet printing head is mobile between a printing area and said service position.

21. Inkjet printer according to claim 19, wherein said receptacle is in the form of a substantially level wall parallel to a front surface of said printing head.

22. Inkjet printer according to claim 21, wherein said receptacle is slidably supported with respect to a fixed structure of the printer along a direction substantially parallel to the printing stroke of said printing head.

23. Inkjet printer according to claim 19, wherein said intermediate member is rotatable about a pivot and is connected with said receptacle with an articulated joint.

24. Inkjet printer comprising:

an inkjet printing head;

a protective cap mobile between a position distanced from said printing head and a position in contact with said printing head in a service position; and a receptacle for the collection of ink ejected by said printing head, wherein said receptacle is selectively and independently mobile with respect to the protective cap between a working position, facing said printing head in said service position, with said protective cap in said distanced position, and a rest position displaced with respect to said printing head and such as to allow the coupling in contact between said protective cap and said printing head in said service position, and wherein said receptacle is mobile between said working position and said rest position along a horizontal direction substantially parallel to the movement of said printing head in a relative printing area.

25. Printer according to claim 24, wherein said inkjet printing head is mobile between said printing area and said service position.

26. Inkjet printer according to claim 24, wherein said receptacle is part of a cleaning device that in turn comprises a control mechanism adapted to control said receptacle to move it between said working position and said rest position, said control mechanism being of the type including a helical groove and an intermediate member adapted to be controlled by said helical groove to move said receptacle.

27. Inkjet printer according to claim 24, wherein said protective cap is operatively associated with a cleaning blade and selective moving mechanisms of said protective cap and of said cleaning blade with respect to said printing head are also provided, to move said protective cap between said distanced position and said position in contact with said printing head and to move said cleaning blade between a non-operative position and a cleaning position, wherein, in said cleaning position, said cleaning blade interferes with said printing head and said protective cap is in said distanced position from said printing head, and wherein said protective cap is in said position in contact with said printing head, whereas said receptacle is in said rest position.

* * * * *